US009187198B2

(12) United States Patent
Matheyka

(10) Patent No.: US 9,187,198 B2
(45) Date of Patent: Nov. 17, 2015

(54) METHOD OF FILLING DRY SOUP PACKETS IN A PACKET FILLING PLANT USING A FILLING MACHINE AND AN APPARATUS THEREFOR, AND A METHOD OF FILLING BAGS WITH EITHER LIQUIDS OR SOLIDS IN A FILLING PLANT AND AN APPARATUS THEREFOR

(75) Inventor: Thomas Matheyka, Eppstein (DE)

(73) Assignee: KHS GmbH, Dortmund (DE)

( * ) Notice: Subject to any disclaimer, the term of this patent is extended or adjusted under 35 U.S.C. 154(b) by 778 days.

(21) Appl. No.: 12/388,083

(22) Filed: Feb. 18, 2009

(65) Prior Publication Data

US 2010/0037561 A1 Feb. 18, 2010

Related U.S. Application Data

(63) Continuation-in-part of application No. PCT/EP2007/007220, filed on Aug. 16, 2007.

(30) Foreign Application Priority Data

Aug. 18, 2006 (DE) ..... 10 2006 038 707

(51) Int. Cl.
*B65B 59/04* (2006.01)
*B65B 43/46* (2006.01)

(52) U.S. Cl.
CPC ..... *B65B 59/04* (2013.01); *B65B 43/465* (2013.01)

(58) Field of Classification Search
CPC ..... B65B 1/04; B65B 43/46; B65B 43/465; B65B 59/04; B65G 21/02; B65G 21/06
USPC ..... 141/68, 103, 166, 313, 315, 316; 198/860.1, 860.2, 861.1
See application file for complete search history.

(56) References Cited

U.S. PATENT DOCUMENTS

| | | | | |
|---|---|---|---|---|
| 1,667,930 | A * | 5/1928 | Edmunds | 141/135 |
| 4,807,420 | A | 2/1989 | Barker | |
| 8,104,376 | B2 | 1/2012 | Eder | |
| 2005/0153427 | A1 | 7/2005 | Eder et al. | |

FOREIGN PATENT DOCUMENTS

| | | |
|---|---|---|
| DE | 10 36 746 | 8/1958 |
| DE | 90 04 208 | 6/1990 |

(Continued)

*Primary Examiner* — Christopher Kim
(74) *Attorney, Agent, or Firm* — Nils H. Ljungman & Associates

(57) ABSTRACT

A method of filling dry vegetable soup packets in a packet filling plant using a filling machine and an apparatus therefor, and a method of filling bags with either liquids or solids in a filling plant and an apparatus therefor. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 7 Drawing Sheets

(56) References Cited

FOREIGN PATENT DOCUMENTS

| | | |
|---|---|---|
| DE | 102 35 929 | 3/2004 |
| EP | 07 12 783 | 5/1996 |
| EP | 0 765 807 | 4/1997 |
| EP | 0 999 137 | 5/2000 |
| JP | 59142920 | 8/1984 |
| JP | H02191134 | 7/1990 |
| JP | 8175598 | 7/1996 |
| JP | 11189206 | 7/1999 |
| WO | WO 03/045786 | 6/2003 |

* cited by examiner

METHOD OF FILLING DRY SOUP PACKETS IN A PACKET FILLING PLANT USING A FILLING MACHINE AND AN APPARATUS THEREFOR, AND A METHOD OF FILLING BAGS WITH EITHER LIQUIDS OR SOLIDS IN A FILLING PLANT AND AN APPARATUS THEREFOR

CONTINUING APPLICATION DATA

This application is a Continuation-In-Part application of International Patent Application No. PCT/EP2007/007220, filed on Aug. 16, 2007, which claims priority from Federal Republic of Germany Patent Application No. 10 2006 038 707.4, filed on Aug. 18, 2006. International Patent Application No. PCT/EP2007/007220 was pending as of the filing date of this application. The United States was an elected state in International Patent Application No. PCT/EP2007/007220.

BACKGROUND

1. Technical Field

The present application relates to a method of filling instant vegetable soup packets in a packet filling plant using a filling machine and an apparatus therefor, and a method of filling bags with either liquids or solids in a filling plant and an apparatus therefor. The present application further relates to a device for the treatment of flexible, tubular structures, in one possible embodiment bags, with at least one conveying device and at least one processing device that is arranged along the conveying device and acts upon the structures. The conveying device is used to transport the structures, often from one processing device to the next. The conveying device may be designed as a belt conveyor, chain conveyor, cable conveyor, etc.

2. Background Information

Background information is for informational purposes only and does not necessarily admit that subsequently mentioned information and publications are prior art.

Some devices are for the treatment of flexible, tubular structures, for example bags. These devices comprise at least one conveying device and at least one processing device that is arranged along the conveying device and acts upon the structures. The conveying device is used to transport the structures from one processing device to the next. The conveying device may be designed as a belt conveyor, chain conveyor, cable conveyor, etc. In addition, devices known as form, fill and sealing machines are known from practice and are used to fill a bag with liquid or dry products, for example. In the first case, this can be the ingredients for an instant soup. The latter variant includes the filling of beverages, for example.

These form, fill and sealing machines and devices for the treatment of flexible, tubular structures are often very expansive and mechanically complex. Furthermore, they are produced specifically for the intended purpose. This means that a device for the filling of packet soups is designed fundamentally differently than one used to fill beverage bags. This is in part due to the fact that the filled beverage bags, for example, must or should be closed by a sealing unit following the filling process.

In any case, the structure of these devices varies according to the intended purpose, although identical components are used to a certain extent. This leads to complex and correspondingly cost-intensive manufacture and makes any maintenance and repair work more difficult. The present application seeks to alleviate these issues.

The object of the present application is to refine such a device for the treatment of flexible, tubular structures, in one possible embodiment bags, so as to permit standardized and simplified manufacture together with reduced maintenance and repair effort.

Object or Objects

To achieve this object, the present application teaches a generic device for the treatment of flexible, tubular structures designed such that the conveying device and/or the processing device are modular and interchangeable. The modular design and resulting interchangeability mean that both the conveying device and the processing device are independent machines with their own power supply, own frame, own motors and possibly their own housing, i.e. can in principle be operated self-sufficiently. It has further been shown to be if the conveying device and the processing device are coupled together by means of at least one non-permanent connector.

SUMMARY

The modular design of the conveying device on the one hand and the processing device or multiple processing devices on the other essentially ensures or promotes that the units comprising the desired device can not only be flexibly arranged, but also that they can be easily exchanged if necessary or desired. This makes it possible to completely decouple a malfunctioning processing device from the machine or the complete device, and continue operation by deploying a replacement processing device.

The present application also enables the flexible configuration of the sequence of individual processing devices and thus adaptation to the specific purpose intended. The processing devices are principally filling modules, treatment modules and packing/closing modules. The filling modules can be differentiated according to solids filling modules and liquids filling modules, depending on whether solid or liquid products are metered into the structures or bags. The filling modules are generally metering devices.

Other possible treatment modules can provide for the aseptic treatment or sterilization of the structure or the bag prior to filling. It is alternatively or additionally possible to purge the structure or the bag with an (inert) gas, steam, etc. The irradiation of the structures or bags with UV radiation, infrared radiation or X-rays to kill germs may also take place in such a treatment module. In other words, the treatment modules are routinely one or multiple sterilization stations.

Finally, a packing/closing module or multiple packing/closing modules seal the respective structure or bag, if necessary or desired. This is true if the structures are film bags with a spout that is configured to be sealed or shut off. It is also possible, however, to seal an opening unmodified during the filling process in the packing/closing module. Finally, the packing/closing module essentially ensures or promotes that the treated structures, or filled bags, are removed from the conveying device and placed into containers, transferred to magazines or otherwise prepared for further transport or additional process steps. The packing/closing module can also include a printing station, or be configured as such if the structures or bags are to be overprinted, provided with a sticker, etc. The packing/closing module is most often realized as or includes a sealing unit.

It is understood that each module, i.e. the filling module, the treatment module and also the packing/closing module can include several of the indicated elements or machines and/or that there are several of the respective modules. It is therefore conceivable that the filling module is equipped with a plurality of several metering devices, or that there are a plurality of several filling modules that fill various ingredients of an instant soup into a bag. Likewise, the treatment module may comprise various sterilization stations, and the packing/closing module may be equipped not only with a sealing unit, but also with a gripper device for removing the structures or bags.

In each case, the conveying device and the respective processing device or the filling module, the treatment module and/or the packing/closing module and their respective elements (machines) are connected to another by means of at least one non-permanent connector. Typically there are two connectors, namely a mechanical connector and an electrical connector. The mechanical connector essentially ensures or promotes that the respective module or processing device is non-permanently connected to, centered on and aligned with the conveying device. The electrical connector provides a non-permanent electrical connection between the respective processing device and the conveying device for the supply of energy to the necessary or desired electric motors and/or for the exchange of data.

The present application teaches that the connector non-permanently couples the respective processing device to the conveying device. However, it is fundamentally possible, alternatively or additionally, that the processing devices are non-permanently coupled together by means of one or multiple connectors.

Each respective connector comprises at least two parts with a connecting element on the conveying device and a mating element on the processing device, or vice-versa. With the mechanical connector, the connecting element on the conveying device generally is designed as a centering element, whereas the mating element on the processing device acts as a receptacle for the centering element. A ball joint-like centering element has proven effective here, whereby other designs are also conceivable and within the scope of the present application.

The electrical connector, on the other hand, primarily comprises a plug on the processing device and a coupling on the conveying unit, or vice-versa. The plug and the coupling may be configured for the combined transmission of energy and data. Separate plugs and couplings can also be used here. However, in on particular embodiment the conveying device and the respective processing device(s) are connected to a common data bus, which itself receives commands from a control system and forwards these to the conveying device and/or the processing device.

The mechanical connector is typically closed by the weight of the processing station and must, or should be opened against this weight. This means that additional locking measures are not required, or desired, although conceivable. The processing device generally rests with its weight on at least one mechanical connector, and also on at least two possibly adjustable feet.

At least one connector is arranged at the feet end of the conveying unit and/or the processing device. As a result, the receptacle of the processing device can be placed on the centering element, so that the mechanical connector is closed by the weight of the processing device. This may also be used to non-permanently close the electrical connector.

This process also essentially ensures or promotes that the processing device assumes its intended position relative to the conveying device. All, or essentially all, that remains is to change the height of the possibly adjustable feet, if desired. It is also desirable for the electrical connector to be placed at the feet end of the conveying device and the processing device. It has proven effective to arrange the connectors in their entirety or the connecting elements of the connectors on a girder of a frame supporting the conveying device. The interior of this girder may-comprise the data and/or energy line and also the electrical connecting element and/or the electrical coupling.

The arrangement of multiple connectors along the length of the conveying device has proven effective for the optional and interchangeable connection of one or more processing devices in alignment with the conveying device. The connecting elements of the connector are fastened to or placed on the girder.

With regard to the conveying device, the present application discloses an embodiment in which of at least one pair of grippers being mounted on different guide tracks. The gripper pair may comprise a leading gripper and a trailing gripper mounted on different guide tracks that can be moved relative to one another. This is not mandatory or desired, however.

The result is a device for the treatment of flexible, tubular structures, in one possible embodiment for the treatment of bags, which device, due to its modular design, can be adapted to various filling and/or treatment tasks. For example, this device can be used to manufacture instant soup packets by sequentially putting various soup components individually into the respective bags using various metering devices within the framework of the filling module or the multiple filling modules.

The modular structure also makes it possible and conceivable to quickly replace a defective module without interrupting production. The same applies if the module in question requires desires maintenance. Finally, modifications to the modules, such as the erection of scaffolding or the making of adjustments, can be performed during production. As soon as the module is operational, it is non-permanently fixed to the conveying device by means of the connector(s). This process essentially ensures or promotes that the respective module is also centered relative to the conveying unit, wherein the primary advantages lie.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

One possible embodiment of the present application is described in greater detail below illustrated with the accompanying drawings, in which.

DESCRIPTION OF EMBODIMENT OR EMBODIMENTS

Figure 1:
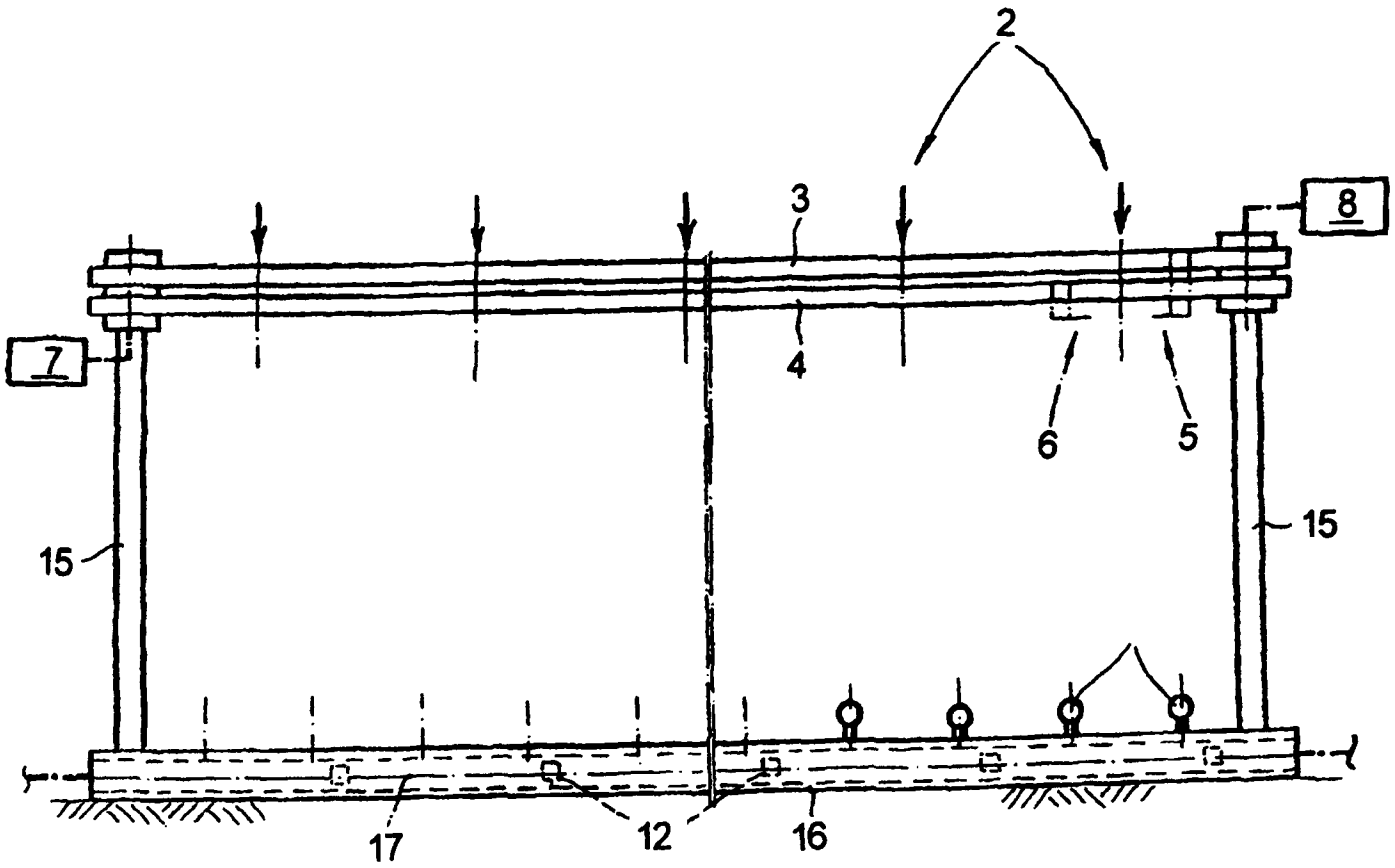
FIG. 1 shows a schematic side view of the device according to the present application.

The figures show a device for the treatment of flexible, tubular structures. The tubular structures in this case are bags 1, but this is not restrictive. In the example given here, the term treatment refers to the filling of the bags 1 using metering devices 2 as is shown by way of example in FIG. 2. Alternatively or in addition thereto, other treatment procedures can be performed, such as an upstream aseptic or sterile treatment of the bags 1, their purging with gas, irradiation to kill germs, the required or desired sealing of the opening following the filling of the bags 1, and finally their removal from the device and packing for subsequent transport. This was already described in detail above.

In addition to the metering device/processing device 2 shown, the basic design of the device also includes a conveying device 3, 4. The conveying device 3, 4 comprises a lead gripper track 3 and a trailing gripper track 4, to which a gripper pair 5, 6 is attached. The leading gripper track 3 and the trailing gripper track 4 can be implemented as circulating toothed belts, chains, cables or similar.

The gripper pair 5, 6 comprises a leading gripper 5 mounted on a leading gripper track 3 and a trailing gripper 6 connected to a trailing gripper track 4. The two guide tracks 3, 4 can be moved relative to one another and are impinged independently from one another by means of the separate motorized drives 7, 8 suggested in FIG. 1. Of course, there may also be only a single drive 7, 8, and it equally possible for there to be a different conveying device 3, 5. In each case the guide tracks 3, 4 are moved as shown in FIG. 1 in an endless loop along an elongated circular track, and essentially ensure or promote by means of their relative motion that in the vicinity of the processing device 2, for example, the gripper pair 5, 6 holds and grabs the bag 1 so that the interior of the bag 1 can be filled with the desired solid or liquid product.

In one possible embodiment, a lead gripper 5 is located on a leading gripper track 4, and a trailing gripper 6 is located on a trailing gripper track 3. Leading gripper 5 and trailing gripper 6 move bag 1 along the circular track or oblong track 3, 4. The circular or oblong track 3, 4 comprises both the leading gripper track 3 and the trailing gripper track 4. A separate motorized drive 8 may move leading gripper track 3. A separate motorized drive 7 may move trailing gripper track 4, as well. The leading gripper track 3 and the trailing gripper track 4 could be moved relatively or independently by the motorized drives 7, 8. For example, operating separate motorized drives 7, 8 simultaneously or substantially simultaneously could be desired for a motion that would allow bag 1, being held by the lead gripper 5 and the trailing gripper 6, to be filled with the desired solid and/or liquid product. In another way of operating the device of the present application, the separate motorized drives 7, 8 could move in separate directions to adjust the leading gripper 5 and the trailing gripper 6 to desirable distances between the leading gripper 5 and the trailing gripper 6, depending on the size of bag 1. The track 3, 4 could be configured as an endless loop which travels in an elongated oblong path. At various points along the path the bag 1 could come into vicinity of a processing device 2. For example, if the present application were being used in soup production, bag 1 could be filled with different dry and/or liquid soup ingredients, depending upon the contents of the various processing devices 2. Each of the process devices 2 could dispense different ingredients.

Figure 3:
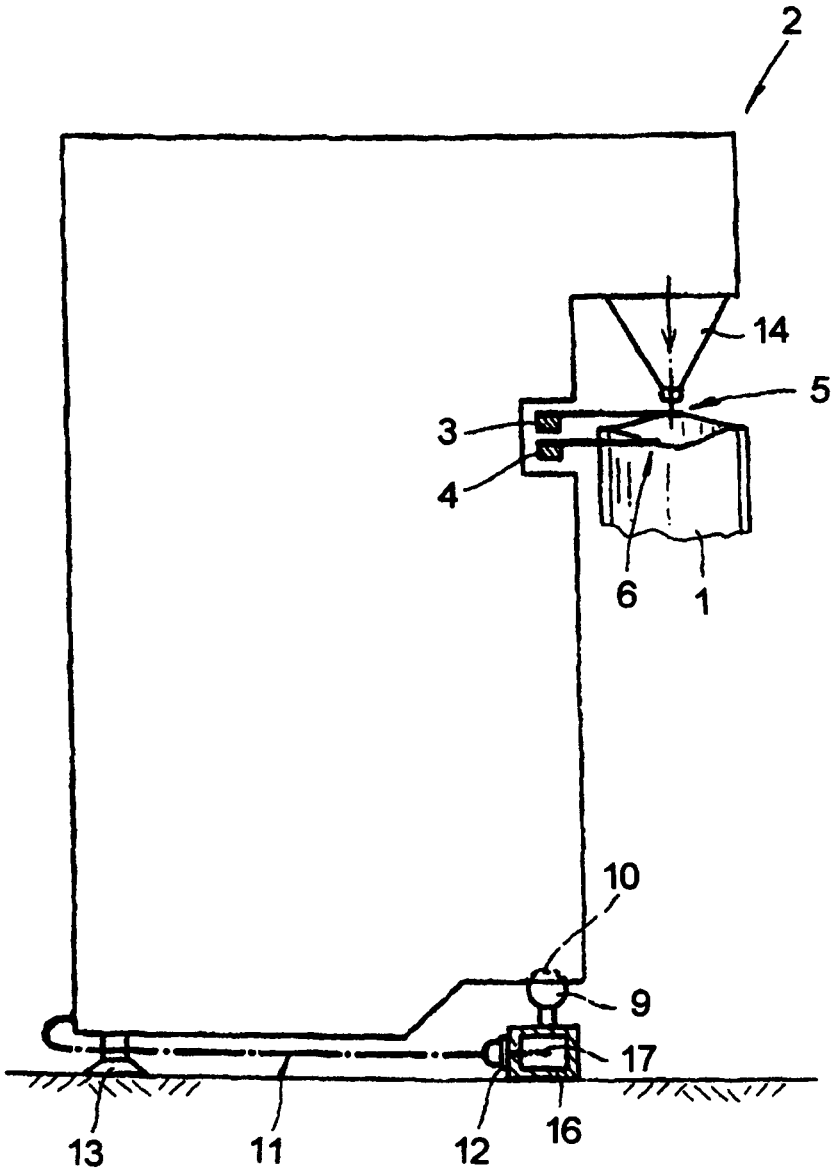
FIG. 3 shows a schematic side view of the object shown in FIG. 2.
Figure 3A:
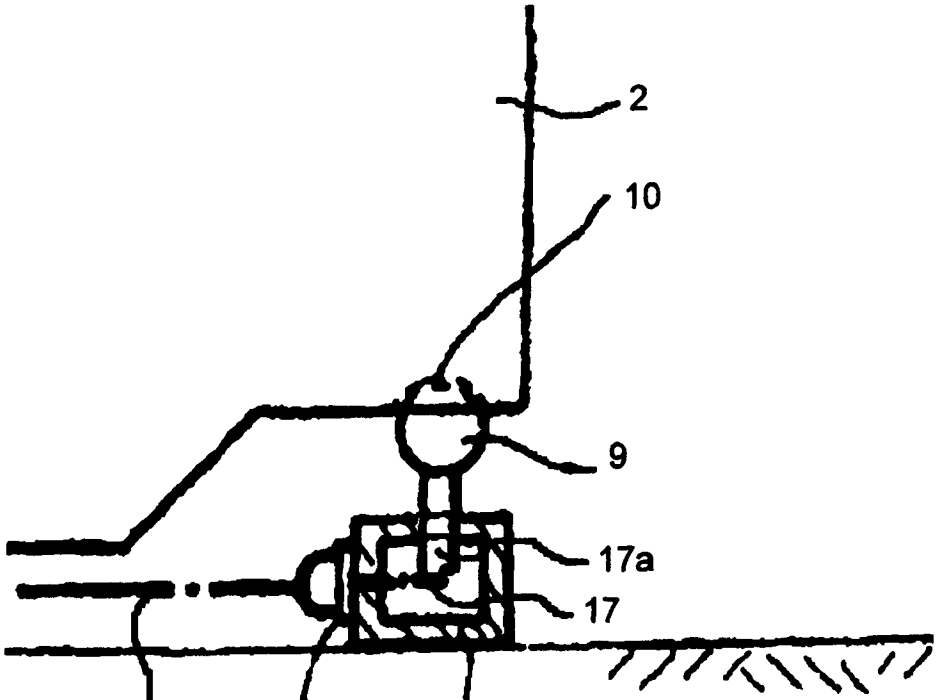
FIG. 3A depicts another possible embodiment in which the processing device 2 could be filled with a certain, predetermined amount of material.
Figure 3B:
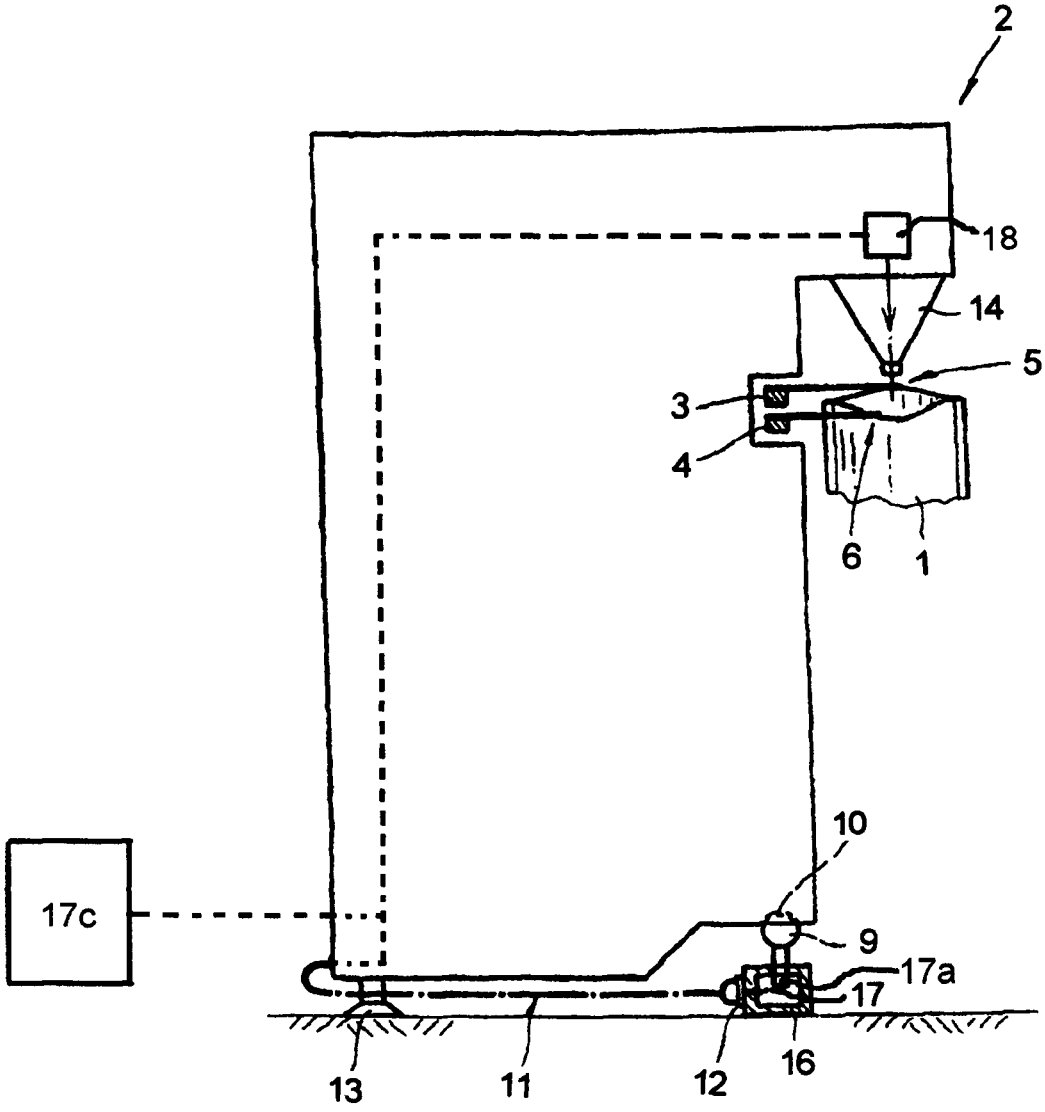
FIG. 3B depicts another possible embodiment in which the processing device 2 has a electro-mechanical transducer 17*a* that measures the weight or mass of the product dispensed into the bag 1.
Figure 3C:
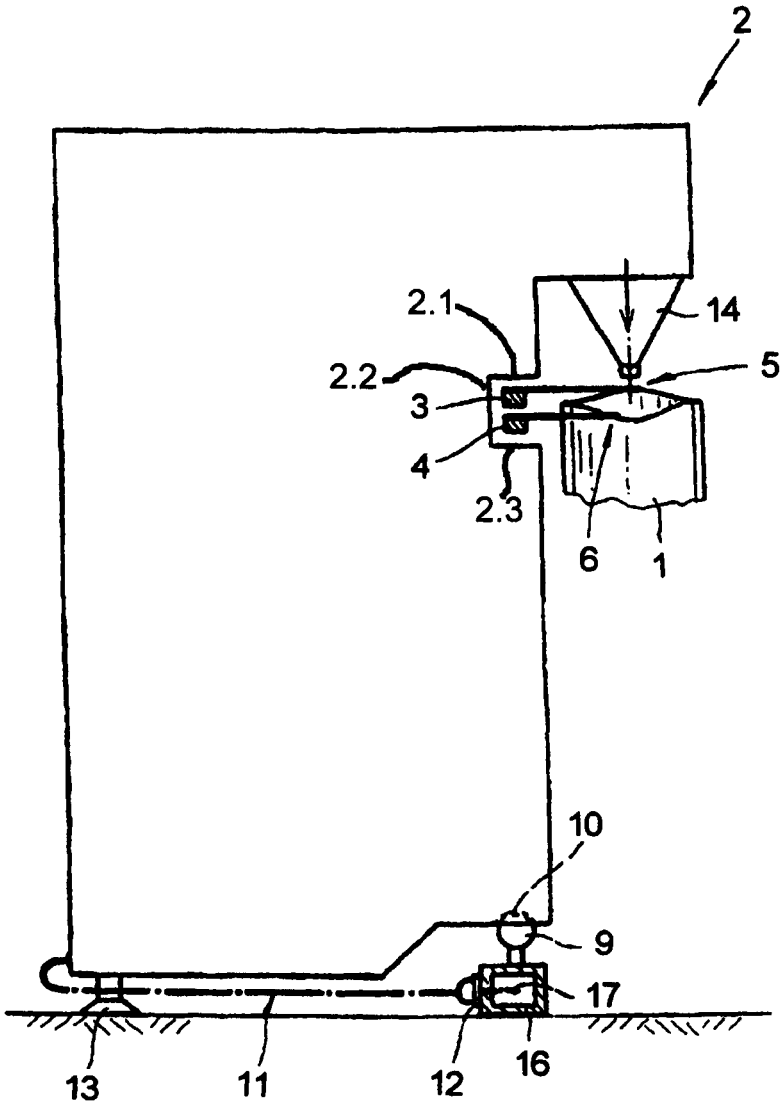

FIG. 3C depicts one embodiment of the present application in which the processing device 2 has a notch, or grove, which is comprised of surfaces 2.1, 2.2, and 2.3. The notch, or grove, could allow for a sufficient clearing area for the track 3, 4 and gripper pair 5, 6 to move in an unrestricted fashion. In other words, the gripper track 3, 4 and gripper pair 5, 6 are not hindered by contacting the processing device 2, since the notch could provide a sufficient area for the gripper track 3, 4 and gripper pair 5, 6 to pass through the processing device 2.

FIG. 1 clearly shows that multiple processing devices 2 acting on the bags 1 are arranged along the conveying device 3, 4. Within the scope of the present application, the individual processing devices 2 are implemented as treatment modules, so that the conveying device 3, 4 and/or the respective processing device 2 are modular and interchangeable. For this purpose, there is at least one connector 9, 10, 11, 12 that non-permanently couples the conveying device 3, 4 with the respective processing device 2.

In the possible embodiment, which should not be understood to be limiting, there is a mechanical connector 9, 10 and an electrical connector 11, 12. Each respective connector 9, 10; 11, 12 comprises at least two parts with a connecting element 9; 12 on the conveying device 3, 4 and a mating element 10; 11 on the processing device, or vice-versa.

The connecting element 9 of the connector 9, 10 is actually a centering element 9, which in this case is realized as a ball joint or comparable centering element 9. The mating element 10 of the mechanical connector 9, 10, on the other hand, is realized as a corresponding receptacle 10 so that the processing device or metering device 2 is centered when connected to the conveying unit 3, 4 by means of two mechanical connectors 9, 10 at this location.

The mechanical connector 9, 10, is actually closed by the weight of the processing device 2 and opened against this weight. The processing device or metering device 2 rests with its weight on the two connectors 9, 10 and on two possibly adjustable feet 13, which can best be seen in FIG. 3.

FIG. 3A depicts another possible embodiment in which the processing device 2 could be filled with a certain, predetermined amount of material. The total weight of the processing device 2 could be measured at a electro-mechanical transducer 17*a* connected to mechanical connector 9, 10. A bag 1 could be filled by the processing device 2 with a predetermined amount of material or predetermined weight. The bag 1 could have a fill line to indicate the predetermined amount of material to be dispensed. The amount of material to be dispensed, could be determined by measuring how much material is subtracted from the total weight of material in processing device 2. This process would be repeated for all other dispensing amounts until the processing device 2 is substantially empty. This measurement could be recorded in a central computer which could display the amount of material dispensed via a electronic display. An operator could then determine that the processing device 2 is calibrated to dispense the predetermined amount of material into each bag 1. For example, a processing device 2 is filled with fifty ounces of flour. The processing device 2 is activated in order to fill a bag 1 with a predetermined amount of weight of flour, for example ten ounces of flour. The processing device 2 is then deactivated once the flour is filled to ten ounces. The electromechanical transducer 17*a* weighs the processing device 2. The weight of processing device 2 registers as forty ounces, which is ten ounces lighter. Also, in other embodiments the predetermined amount or weight of product could vary.

Figure 4:
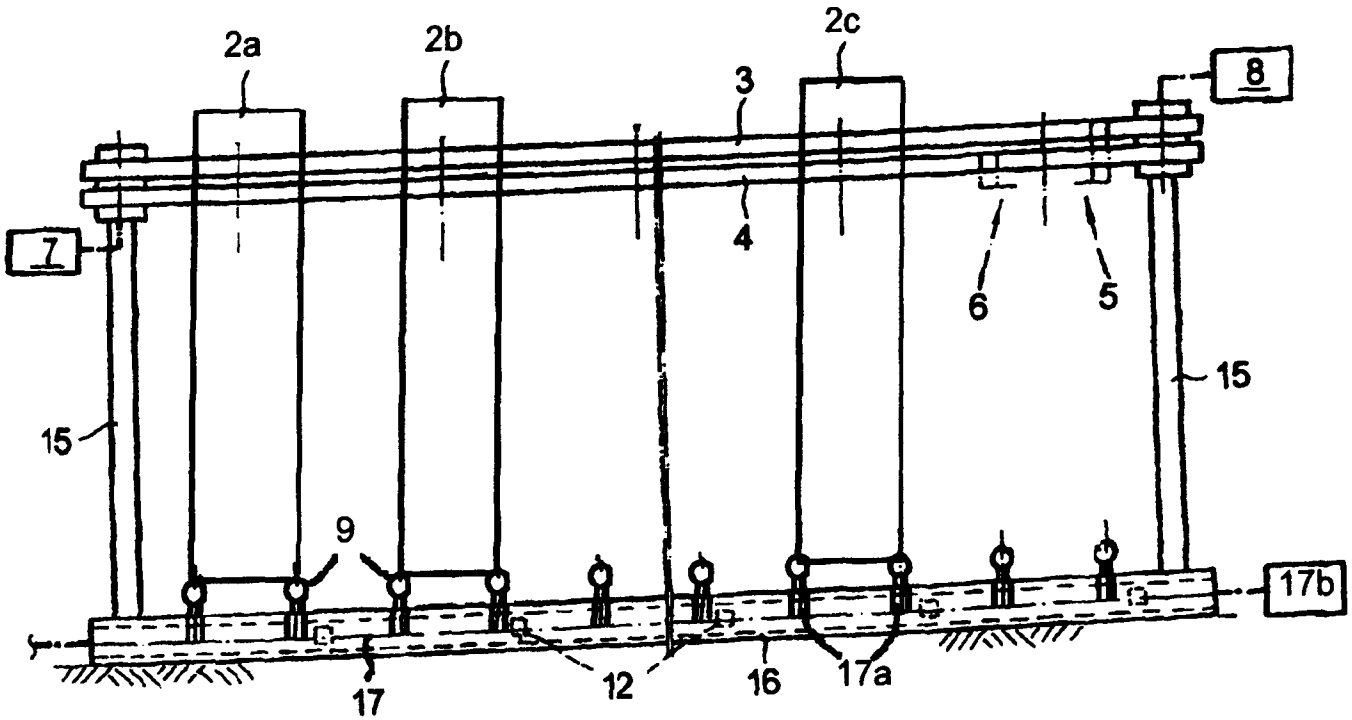
FIG. 4 depicts another possible embodiment of the present application configured as a modular arrangement.

FIG. 4 depicts one possible embodiment in which the input weight of the product dispensed into each bag 1 could be measured. The input recordings of a bag 1 could be measured during the bag's travel along a preliminary running of conveying device 3, 4. During this preliminary running of conveying device 3, 4, recordings of the input weight of the product being placed into a bag 1 could be made by a electromechanical transducers 17*a*. The weight data could then be sent to a central computer 17*b*, which logs the weight data, by the data/energy line 17 to set a measurement system. The central computer 17*b* could promote consistency of the contents of the finished bags 1 by indicating that an error has occurred in the weight log. Furthermore, the recording of this data could also indicate whether or not an individual metering or processing device 2*a*, 2*b*, or 2*c* is function properly. If one of the processing devices 2*a*, 2*b*, or 2*c* is not functioning properly, then that device could be adjusted accordingly. For example, processing device 2*a* could be designed or adjusted to measure out eight ounces of flour. However, the input weight recorded at the corresponding electromechanical transducers 17*a* of the processing device 2*a* is registering as four ounces of flour per bag 1. The central computer 17*b*, which logged the intended input of flour as eight ounces, detects that the processing device 2*a* is only dispensing four ounces of flour. The improper reading, registering on the central computer, could then indicate that the processing device 2*a* needs to be adjusted or replaced.

FIG. 3B depicts another possible embodiment in which the processing device 2 has a electro-mechanical transducer 17*a* that measures the weight or mass of the product dispensed into the bag 1. This input weight mass data is sent to the processing device control unit 17*c*. Processing device control unit 17*c* is set or calibrated to store a desired input weight or mass for the amount of product to be dispensed into the bag 1. The processing device unit 17*c* sends a signal that activates and deactives the dispensing valve 18 according to the desired input weight or mass of the product that is desired.

Figure 2:
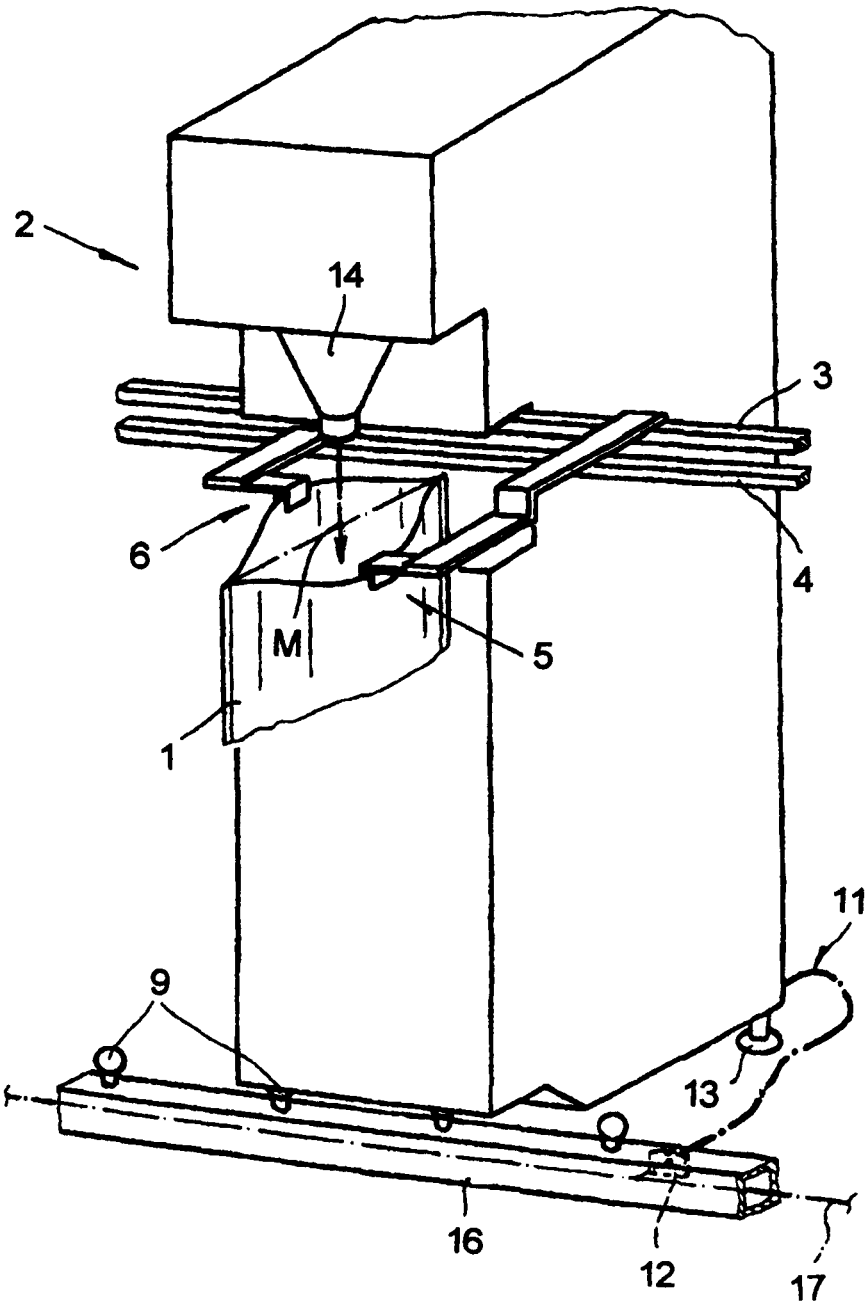
FIG. 2 shows a perspective view of a treatment module in the form of a metering device.

The processing or metering device 2 can be positioned relative to the conveying device 3, 4 either manually or mechanically using a forklift by placing the processing/metering device 2 on or hanging it from the centering elements or connecting elements 9. With this process, the ball joint-like centering element 9 on the conveying device 3, 4, which element 9 is inserted into the receptacle 10 on the processing or fastening/metering device 2, essentially ensures or promotes that the processing or fastening/metering device 2 assumes a fixed and predefined position relative to the conveying device 3, 4. This consequently essentially ensures and essentially guarantees and promotes that a filling funnel 14 for the metering process and visible in FIGS. 2 and 3 is positioned roughly in the area of the center M of the bag.

Both the mechanical connector 9, 10 and the electrical connector 11, 12 are arranged at the feet end of the conveyor device 3, 4 and the processing/metering device 2. This can be seen by comparing FIGS. 2 and 3. The conveying device 3, 4 has a supporting frame 15, 16 with a girder 16 and lateral uprights 15. The girder 16 in this case is a hollow profile, in which a combined data/energy line 17 is run in this embodiment. This profile opens into the connecting element 12 of the electrical connector 11, 12 on the conveying device 3, 4, which is realized as a combined energy/data electrical coupling. The mating connecting element 11 of the electrical connector 11, 12 on the processing/metering device 2 is plugged into this electrical coupling 12 and supplies energy and data to the processing/metering device 2.

It can be seen that a plurality of connectors 9, 10; 11, 12 are arranged along the length of the conveying device 3, 4 for the optional, interchangeable and centered connection of one or more metering/processing devices 2. The girder 16 of the frame 15, 16 for the conveying device 3, 4 accommodates both the respective connecting elements 12 of the electrical connectors 11, 12 and the connecting elements 9 of the mechanical connectors 9, 10.

In other words, there are multiple connectors 9, 10; 11, 12 arranged along the length of the conveying device 3, 4 to provide interchangeable points of connection for various processing devices 2. The girder 16 of the frame 15, 16 is part of the conveying device 3, 4. The girder 16 accommodates both connecting elements 12 of the electrical connectors 11, 12 and the connecting elements 9 of the mechanical connectors 9, 10.

The respective connecting elements 9 of the mechanical connectors 9, 10 are mounted on the girder 16 at the longitudinal end of the girder 16. As a result, not only various metering device and/or processing modules but also other modules, such as filling modules or packing/closing modules, can be arranged along or placed opposite to the conveying device 3, 4.

In another possible embodiment of the present application could be configured as a modular arrangement as seen in FIG. 4. In one example of this embodiment, bag 1 could move along the conveying device 3, 4 to be filled with different instant vegetable soup mix ingredients by various processing devices 2. Each of the processing devices 2*a*, 2*b*, and 2*c* could be configured to fill the bag 1 with a predetermined amount of each instant vegetable soup mix ingredient. This could promote consistency of each bag 1 of instant vegetable soup mix produced. For example, the bag 1 could move along the conveying device 3, 4 and be positioned below processing device 2*a*. The processing device 2*a* could fill the bag 1 with powdered vegetable stock to a predetermined amount by weight. The bag 1 then moves along the conveying device 3, 4 to the processing device 2*b* which fills the bag 1 with dehydrated carrots to a predetermined amount by weight. The bag 1 then moves along conveying device 3, 4 to the processing device 2*c* which fills the bag 1 with dehydrated peas to a predetermined amount to weight. Additional processing devices 2 could be positioned along the conveying device 3, 4 to add any additional desired ingredients. Each of these additional ingredients could also be dispensed in predetermined amounts to promote consistency in every bag 1 of instant vegetable soup mix produced.

In another embodiment, the bags 1 could be filled with a liquid mixture, such as orange juice. A processing device 2*a* could be configured to dispense a predetermined amount of orange juice without pulp into a bag 1. Another processing device 2*b* could be configured to dispense a predetermined amount of orange pulp into the bag 1. Similar to the previous example of instant vegetable soup mix, this could promote consistency of the amount of pulp in each bag 1 of orange juice produced.

Furthermore, as with various soup mixes or like products, heavier ingredients could settle at the bottom of the processing devices 2. Another undesirable situation could be the tendency of ingredients to clump together. A modular arrangement of an embodiment of the present application, with various processing devices that dispense various soup ingredients, could restrict and/or minimize the frequency of settling and clumping among ingredients.

In an example of the present application depicted as a modular unit as seen in FIG. 4, a bag 1 could be filled with different ingredients of instant vegetable soup mix. The bag 1 moves along the conveying device 3, 4 and is positioned below processing device 2*a*. The processing device 2*a* could fill the bag 1 with powdered vegetable stock to a predetermined amount. The bag 1 then moves along the conveying device 3, 4 to the processing device 2*b* which fills the bag with dehydrated carrots to a predetermined amount. The bag 1 then moves along conveying device 3, 4 to the processing device 2*c* which fills the bag 1 with dehydrated peas to a predetermined amount. Additional processing devices 2 could be positioned along the conveying device 3, 4 to add any additional desired ingredients. Since the ingredients have been filled at separate processing devices 2, and in a certain order, instances of clumping and settling could be reduced.

The present application relates to a device for the treatment of flexible, tubular structures, in one possible embodiment bags 1. This has at least one conveying device 3, 4 and at least one processing device 2 that is arranged along the conveying device 3, 4 and acts upon the structures. The present application teaches that the conveying device 3, 4 and/or the processing device are modular and interchangeable.

One feature or aspect of an embodiment is believed at the time of the filing of this patent application to possibly reside broadly in a device for the treatment of flexible, tubular structures, in one possible embodiment bags 1, with at least one conveying device 3, 4 and at least one processing unit 2 that is arranged along the conveying device 3, 4 and acts upon the structures, characterized in that the conveying device 3, 4 and/or the processing device 2 are modular and interchangeable.

Another feature or aspect of an embodiment is believed at the time of the filing of this patent application to possibly reside broadly in the device, wherein the conveying device 3, 4 and the processing device 2 are coupled together by means of at least one non-permanent connector 9, 10; 11, 12.

Yet another feature or aspect of an embodiment is believed at the time of the filing of this patent application to possibly reside broadly in the device, wherein there is a mechanical connector 9, 10 and an electrical connector 11, 12.

Still another feature or aspect of an embodiment is believed at the time of the filing of this patent application to possibly reside broadly in the device, wherein the connector 9, 10; 11, 12 comprises at least two parts with a connecting element 9; 12 on the conveying device 3, 4 and a mating element 10; 11 on the processing device 2, or vice-versa.

A further feature or aspect of an embodiment is believed at the time of the filing of this patent application to possibly reside broadly in the device, wherein the mechanical connector 9, 10; 11, 12 is in fact closed by the weight of the processing device 2 and opened against this weight.

Another feature or aspect of an embodiment is believed at the time of the filing of this patent application to possibly reside broadly in the device, wherein the processing device 2 rests with its weight on the at least one mechanical connector 9, 10; 11, 12 and at least two preferably adjustable feet 13.

Yet another feature or aspect of an embodiment is believed at the time of the filing of this patent application to possibly reside broadly in the device, wherein the respective connector 9, 10; 11, 12 is arranged at the feet end of the conveying device 3, 4 and/or the processing device 2.

Still another feature or aspect of an embodiment is believed at the time of the filing of this patent application to possibly reside broadly in the device, wherein multiple connectors 9, 10; 11, 12 are arranged along the length of the conveying device 3, 4 for the optional and interchangeable attachment of one or more processing devices 2 to, and in alignment with, the conveying device 3, 4.

A further feature or aspect of an embodiment is believed at the time of the filing of this patent application to possibly reside broadly in the device, wherein the connecting element 9; 12 of the connector 9, 10; 11, 12 is attached to a girder 16 of a frame 15, 16 supporting the conveying device 3, 4.

Another feature or aspect of an embodiment is believed at the time of the filing of this patent application to possibly reside broadly in the device, wherein the conveying device 3, 4 has at least one gripper pair 5, 6 for the structures connected to guide tracks 3, 4.

Yet another feature or aspect of an embodiment is believed at the time of the filing of this patent application to possibly reside broadly in a method of filling dry vegetable soup packets in a packet filling plant using a filling machine, said method comprising the steps of: disposing a first modular unit adjacent but not in sufficient contact with a conveying apparatus to significantly interfere with amounts and weights dispensed by said first modular unit, which said conveying apparatus is configured to move bags under said first modular unit to be filled with a first ingredient, such as powdered vegetable stock; conveying a first bag with said conveying apparatus to said first modular unit which is configured and disposed to fill a first ingredient, such as powdered vegetable stock, into said first bag; disposing said first bag under a first opening of said first modular unit; weighing said first modular unit with a first weighing arrangement; sending a signal to a control unit from said first weighing arrangement in said first modular unit indicating the weight of said first modular unit; sending a signal from said control unit to said first dispensing unit in said first modular unit to dispense said first ingredient, such as powdered vegetable stock, into said first bag; dispensing said first ingredient, such as powdered vegetable stock, into said first bag; weighing, substantially simultaneously with said dispensing, said first modular unit with said first weighing arrangement and sending a signal to said control unit indicating the weight of said first modular unit during said dispensing; sending a signal from said control unit to said first dispensing arrangement to close said first dispensing arrangement upon a predetermined weight of said first ingredient, such as powdered vegetable stock, being dispensed; storing the weight of said first modular unit in said control unit in preparation for a second bag to be filled with said first ingredient, such as powdered vegetable stock; disposing a second modular unit adjacent but not contacting said conveying apparatus configured to move bags under said second modular unit to be filled with a second ingredient, such as dehydrated carrots; conveying said first bag with said conveying apparatus to said second modular unit which is configured and disposed to fill a second ingredient, such as dehydrated carrots, into said first bag; disposing said first bag under a second opening of said second modular unit; weighing said second modular unit with a second weighing arrangement; sending a signal to a control unit from said second weighing arrangement in said second modular unit indicating the weight of said second modular unit; sending a signal from said control unit to said second dispensing unit in said second modular unit to dispense said second ingredient, such as dehydrated carrots, into said first bag; dispensing said second ingredient, such as dehydrated carrots, into said first bag; weighing, substantially simultaneously with said dispensing, said second modular unit with said second weighing arrangement and sending a signal to said control unit indicating the weight of said second modular unit during said dispensing; sending a signal from said control unit to said second dispensing arrangement to close said second dispensing arrangement upon a predetermined weight of said second ingredient, such as dehydrated carrots, being dispensed; storing the weight of said second modular unit in said control unit in preparation for said second bag to be filled with said second ingredient, such as dehydrated carrots; disposing a third modular unit adjacent but not contacting said conveying apparatus configured to move bags under said third modular unit to be filled with a third ingredient, such as dehydrated peas; conveying said first bag with said conveying apparatus to said third modular unit being configured and disposed to fill a third ingredient, such as dehydrated peas, into said first bag; disposing said first bag under a third opening of said third modular unit; weighing said third modular unit with a third weighing arrangement; sending a signal to a control unit from said third weighing arrangement in said third modular unit indicating the weight of said third modular unit; sending a signal from said control unit to said third dispensing unit in said third modular unit to dispense said third ingredient, such as dehydrated peas, into said first bag; dispensing said third ingredient, such as, dehydrated peas, into said first bag; weighing, substantially simultaneously with said dispensing, said third modular unit with said third weighing arrangement and sending a signal to said control unit indicating the weight of said third modular unit during said dispensing; sending a signal from said control unit to said third dispensing arrangement to close said third dispensing arrangement upon a predetermined weight of said third ingredient, such as dehydrated peas, being dispensed; storing the weight of said third modular unit in said control unit in preparation for said second bag to be filled with said third ingredient, such as dehydrated peas; conveying said second bag with said conveying apparatus to said first modular unit which is configured and disposed to fill said first ingredient, such as powdered vegetable stock, into said second bag; disposing said second bag under said first opening of said first modular unit; weighing said first modular unit with said first weighing arrangement; sending a signal to said control unit from said first weighing arrangement in said first modular unit indicating the weight of said first modular unit; sending a signal from said control unit to said first dispensing unit in said first modular unit to dispense said first ingredient, such as powdered vegetable stock, into said second bag; dispensing said first ingredient, such as powdered vegetable stock, into said second bag; weighing, substantially simultaneously with said dispensing, said first modular unit with said first weighing arrangement and sending a signal to said control unit indicating the weight of said first modular unit during said dispensing; sending a signal from said control unit to said first dispensing arrangement to close said first dispensing arrangement upon a predetermined weight of said first ingredient, such as powdered vegetable stock, being dispensed; storing the weight of said first modular unit in said control unit in preparation for a third bag to be filled with said first ingredient, such as powdered vegetable stock; conveying said second bag with said conveying apparatus to said second modular unit which is configured and disposed to fill said second ingredient, such as dehydrated carrots, into said second bag; disposing said second bag under said second opening of said second modular unit; weighing said second modular unit with said second weighing arrangement; sending a signal to said control unit from said second weighing arrangement in said second modular unit indicating the weight of said second modular unit; sending a signal from said control unit to said second dispensing unit in said second modular unit to dispense said second ingredient, such as dehydrated carrots, into said second bag; dispensing said second ingredient, such as powdered vegetable stock, into said second bag; weighing, substantially simultaneously with said dispensing, said second modular unit with said second weighing arrangement and sending a signal to said control unit indicating the weight of said first second modular unit during said dispensing; sending a signal from said control unit to said second dispensing arrangement to close said second dispensing arrangement upon a predetermined weight of said second ingredient, such as dehydrated carrots, being dispensed; storing the weight of said second modular unit in said control unit in preparation for a third bag to be filled with said second ingredient, such as dehydrated carrots; conveying said second bag with said conveying apparatus to said third modular unit which is configured and disposed to fill said third ingredient, such as dehydrated peas, into said second bag; disposing said second bag under said third opening of said third modular unit; weighing said third modular unit with said third weighing arrangement; sending a signal to said control unit from said third weighing arrangement in said third modular unit indicating the weight of said third modular unit; sending a signal from said control unit to said third dispensing unit in said third modular unit to dispense said third ingredient, such as dehydrated peas, into said second bag; dispensing said third ingredient, such as powdered vegetable stock, into said second bag; weighing, substantially simultaneously with said dispensing, said third modular unit with said third weighing arrangement and sending a signal to said control unit indicating the weight of said third modular unit during said dispensing; sending a signal from said control unit to said third dispensing arrangement to close said third dispensing arrangement upon a predetermined weight of said third ingredient, such as dehydrated peas, being dispensed; storing the weight of said third modular unit in said control unit in preparation for a third bag to be filled with said third ingredient, such as dehydrated peas; and continuing said method with a third bag and subsequent bags.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Jan. 10, 2008, and/or cited elsewhere are hereby incorporated by reference as if set forth in their entirety herein as follows: WO 03/045786, having the title "APPARATUS AND METHOD FOR HANDLING A TOBACCO POUCH-LIKE PACKAGING," published on Jun. 5, 2003; DE 90 04 208, published on Jun. 13, 1990; and EP 0 999 137, having the title "POUCH CARRYING APPARATUS," published on May 10, 2000.

The following patents, patent applications or patent publications, are hereby incorporated by reference as if set forth in their entirety herein: DE 102 35 929 A 1, having the following English translation of the German title "DEVICE FOR FILLING STAND-ALONE FLAT-BOTTOM BAGS," published on Apr. 4, 2004; and EP 0 765 807 A 1, having the title "MANIPULATOR DEVICE FOR HANDLING FLEXIBLE BAGS," published on Mar. 2, 1997.

U.S. patent application Ser. No. 12/341,564 filed on Dec. 22, 2008, having inventor(s) Thomas MATHEYKA, and its corresponding Federal Republic of Germany Patent Application No. D.E.: 10 2006 028 796.7, and International Patent Application No. PCT/EP2007/05299, filed on Jun. 20, 2007, having WIPO Publication No. WO 2007/147566 and inventor(s) Thomas MATHEYKA are hereby incorporated by reference as if set forth in their entirety herein.

U.S. patent application Ser. No. 12/342,440 filed on Dec. 23, 2008, having inventor(s) Thomas MATHEYKA, and its corresponding Federal Republic of Germany Patent Application No. 10 2006 030 255.9, filed on Jul. 30, 2006, and International Patent Application No. PCT/EP2007/008402, filed on Jun. 20, 2007, having WIPO Publication No. WO 2008/000376 and inventor(s) Thomas MATHEYKA are hereby incorporated by reference as if set forth in their entirety herein.

The patents, patent applications, and patent publication listed above in the four preceding paragraphs are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 038 707.4, filed on Aug. 18, 2006, having inventor Thomas MATHEYKA, and DE-OS 10 2006 038 707.4 and 10 2006 038 707.4, and International Application No. PCT/EP2007/007220, filed on Aug. 16, 2007, having WIPO Publication No. WO2008/019840 and inventor Thomas MATHEYKA, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/007220 and German Patent Application 10 2006 038 707.4 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/007220 and DE 10 2006 038 707.4 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A container handling arrangement configured to handle flexible, tubular containers, including bags, said container handling arrangement comprising:

a conveying device configured to hold containers made of flexible, tubular material, and to move the containers along a path of movement;

a processing unit to treat at least one of the containers with a treatment;

a support arrangement to support a portion of the weight of said processing unit;

said processing unit comprising an upper portion disposed adjacent said conveying device, and a lower portion disposed below said conveying device;

said upper portion comprising a processing device to perform said treatment of the containers;

said processing unit comprising a total weight, said total weight comprising a first portion and a second portion;

said first portion being supported by a foot section;

said second portion being supported by said support arrangement;

said lower portion comprising: said foot section to support said first portion of said total weight of said processing unit not supported by said support arrangement, and a support section to rest on and connect to said support arrangement in a detachable, non-permanent, mechanical connection;

said support section of said processing unit being connected to said support arrangement; and said processing unit being modular and replaceable by an additional processing unit, upon disconnection of said support section of said processing unit from said support arrangement, to permit the treatment of at least one of the containers using said processing unit, and to permit a different treatment of at least one additional container using an additional processing unit, to thereby permit said container handling arrangement to perform at least two different treatments of containers.

2. The container handling arrangement according to claim 1, wherein said processing unit is connected to said support arrangement in a detachable, non-permanent, electrical connection.

3. The container handling arrangement according to claim 2, wherein:

said support section of said processing unit comprises a first mechanical connecting element;

said support arrangement comprises a second mechanical connecting element; and said first mechanical connecting element engages with said second mechanical connecting element to form the detachable, non-permanent, mechanical connection.

4. The container handling arrangement according to claim 3, wherein:

said processing unit rests on said support arrangement such that the weight force of said processing unit establishes and maintains the detachable, non-permanent, mechanical connection; and said processing unit is detachable from said support arrangement by lifting said processing unit off of said support arrangement to disconnect the detachable, non-permanent, mechanical connection.

5. The container handling arrangement according to claim 4, wherein said foot section of said processing unit comprises at least two adjustable feet.

6. The container handling arrangement according to claim 5, wherein:

said support arrangement comprises a plurality of second mechanical connecting elements disposed along the length of said conveying device to permit interchangeable and detachable mechanical connection of a plurality of said processing units to said support arrangement and adjacent said conveying device; and said support arrangement comprises a plurality of electrical connecting elements disposed along the length of said conveying device to permit interchangeable and detachable electrical connection of a plurality of said processing units to said support arrangement.

7. The container handling arrangement according to claim 6, wherein:

said container handling arrangement comprises a support frame on which said conveying device is supported;

said support arrangement comprises an elongated, bar-shaped portion on or in which are disposed said second mechanical connecting elements and said electrical connecting elements; and said support arrangement is connected to said support frame.

8. The container handling arrangement according to claim 7, wherein:

said conveying device comprises an endless belt and at least one gripper device, supported on said endless belt; and said gripper device comprises a pair gripper elements to grip and hold open flexible, tubular containers for treatment and/or filling, and to suspend the containers from said conveying device throughout movement through said container handling arrangement.

9. The container handling arrangement according to claim 1, wherein:

said support section of said processing unit comprises a first mechanical connecting element;

said support arrangement comprises a second mechanical connecting element;

said first mechanical connecting element engages with said second mechanical connecting element to form the detachable, non-permanent, mechanical connection;

said processing unit rests on said support arrangement such that the weight force of said processing unit establishes and maintains the detachable, non-permanent, mechanical connection; and said processing unit is detachable from said support arrangement by lifting said processing unit off of said support arrangement to disconnect the detachable, non-permanent, mechanical connection.

10. The container handling arrangement according to claim 1, wherein:

said processing unit comprises a first processing unit;

said processing device of said first processing unit comprises a liquid or solid filling module for filling a container with a liquid or a solid product;

said container handling arrangement further comprises a second processing unit; and said processing device of said second processing unit comprises a closing module for closing a filled container with a closure.

11. The container handling arrangement according to claim 10, wherein:

said container handling arrangement further comprises a third processing unit; and said processing device of said third processing unit comprises an aseptic treatment or sterilization module for aseptically treating or sterilizing a container with a treatment medium.

12. The container handling arrangement according to claim 1, wherein:

said processing unit rests on said support arrangement such that solely the weight force of said processing unit establishes and maintains the detachable, non-permanent, mechanical connection; and said processing unit is detachable from said support arrangement solely by lifting said processing unit off of said support arrangement to disconnect the detachable, non-permanent, mechanical connection.

13. The container handling arrangement according to claim 1, wherein said foot section of said processing unit and said support arrangement, upon installation in a container handling plant, rest on a floor of the container handling plant.

14. The container handling arrangement according to claim 1, wherein:

said processing unit comprises a first processing unit to perform a first treatment of a first group of containers;

said container handling arrangement further comprises a second processing unit to treat a second group of the containers with a second, different, treatment;

said second processing unit comprises an upper portion and a lower portion, which said upper portion comprises a processing device to perform said second treatment of the second group of the containers; and said lower portion of said second processing unit comprises a foot section and a support section of the same design as said foot section and said support section of said first processing unit, such that a first mechanical connecting element of said second processing unit is connectable to said second mechanical connecting element of said support arrangement, to permit connection of said second processing unit in place of said first processing unit, upon disconnection of said first mechanical connecting element of said first processing unit from said second mechanical connecting element of said support arrangement.

15. The container handling arrangement according to claim 14, wherein:

said processing devices of said processing units comprise liquid or solid filling modules for filling a container with a liquid or a solid product;

said processing device of said first processing unit is operable to dispense a first type of liquid or solid product;

said processing device of said second processing unit is operable to dispense a second type of liquid or solid product different from said first type of liquid or solid product; and said second processing unit is exchangeable for said first processing unit, upon completion of filling of a group of containers with the first type of liquid or solid product, to permit filling of a second group of containers with the second type of liquid or solid product.

16. The container handling arrangement according to claim 14, wherein:

said processing devices of said processing units comprise aseptic treatment or sterilization modules for aseptically treating or sterilizing a container with a treatment medium;

said processing device of said first processing unit is operable to aseptically treat or sterilize containers with a first type of treatment medium;

said processing device of said second processing unit is operable to aseptically treat or sterilize containers with a second type of treatment medium different from said first type of treatment medium; and said second processing unit is exchangeable for said first processing unit, upon completion of aseptic treatment or sterilization of a group of containers with the first type of treatment medium, to permit aseptic treatment or sterilization of a second group of containers with the second type of treatment medium.

17. The container handling arrangement according to claim 14, wherein:

said processing devices of said processing units comprise closing modules for closing a container with a closure;

said processing device of said first processing unit is operable to close containers with a first type of closure;

said processing device of said second processing unit is operable to close containers with a second type of closure different from said first type of closure; and said second processing unit is exchangeable for said first processing unit, upon completion of closing of a group of containers with the first type of closure, to permit closing of a second group of containers with the second type of closure.

18. The container handling arrangement according to claim 14, wherein:

the container handling arrangement comprises a third processing unit to additionally treat the first group of containers with a third treatment different from the first treatment;

said third processing unit is mechanically connected to said support arrangement, one of upstream or downstream of said first processing unit in the path of movement of the containers; and said support arrangement comprises a plurality of mechanical connecting positions disposed along the length of said conveying device to permit said third processing unit to be moved from its current position on said support arrangement to another position on said support arrangement that is the opposite one of upstream or downstream said first processing unit.

19. The container handling arrangement according to claim 14, wherein:

said processing devices of said first and second processing units comprise liquid or solid filling modules for filling a container with a liquid or a solid product;

said processing device of said first processing unit is operable to dispense a first type of liquid or solid product;

said processing device of said second processing unit is operable to dispense a second type of liquid or solid product different from said first type of liquid or solid product;

said second processing unit is exchangeable for said first processing unit, upon completion of filling of a group of containers with the first type of liquid or solid product, to permit filling of a second group of containers with the second type of liquid or solid product;

the container handling arrangement comprises a third processing unit to additionally close at least one of the first and second groups of containers with a closure; and said third processing unit is mechanically connected to said support arrangement downstream, in the path of movement of the containers, of the position on said support arrangement where said first and second processing units connect to said support arrangement.

20. The container handling arrangement according to claim 19, wherein:

the container handling arrangement comprises a fourth processing unit;

said processing device of said third processing unit is operable to close containers with a first type of closure;

said processing device of said fourth processing unit is operable to close containers with a second type of closure different from said first type of closure; and said fourth processing unit is exchangeable for said third processing unit, upon completion of closing of a group of containers with the first type of closure, to permit closing of a second group of containers with the second type of closure.

* * * * *